US012751532B2

(12) United States Patent
Valle

(10) Patent No.: US 12,751,532 B2
(45) Date of Patent: Oct. 6, 2026

(54) VOLUME HAIR DRYER BRUSH

(71) Applicant: Lourdes Lopez Valle, Mahopac, NY (US)

(72) Inventor: Lourdes Lopez Valle, Mahopac, NY (US)

(73) Assignee: Lourdes Lopez Valle, Mahopac, NY (US)

( * ) Notice: Subject to any disclaimer, the term of this patent is extended or adjusted under 35 U.S.C. 154(b) by 641 days.

(21) Appl. No.: 17/742,200

(22) Filed: May 11, 2022

(65) Prior Publication Data

US 2022/0361646 A1 Nov. 17, 2022

Related U.S. Application Data

(60) Provisional application No. 63/187,305, filed on May 11, 2021, provisional application No. 63/187,331, (Continued)

(51) Int. Cl.
*A45D 2/00* (2006.01)
*A45D 20/12* (2006.01)
(Continued)

(52) U.S. Cl.
CPC ..... *A45D 2/002* (2013.01); *A45D 20/12* (2013.01); *A45D 20/48* (2013.01); *A45D 20/50* (2013.01); *A46B 2200/104* (2013.01)

(58) Field of Classification Search
CPC . A45D 2/00; A45D 2/002; A45D 2/36; A45D 20/00; A45D 20/04; A45D 20/08;
(Continued)

(56) References Cited

U.S. PATENT DOCUMENTS 4,217,915 A 8/1980 Gress et al.
4,721,121 A 1/1988 Adams
(Continued)

FOREIGN PATENT DOCUMENTS

WO WO-2021011247 A1 * 1/2021 ..... A45D 1/04

*Primary Examiner* — Rachel R Steitz
*Assistant Examiner* — Karim Asqiriba
(74) *Attorney, Agent, or Firm* — Potomac Law Group, PLLC; Jamaica Potts Szeliga

(57) ABSTRACT

The present invention relates to a volume hair dryer brush. As one non-limiting example, the invention relates to a volume hair dryer brush with an roughly elliptical barrel. As another non-limiting embodiment, the invention relates to a volume hair dryer brush with a roughly elliptical barrel where the density of the bristles and tufts on the narrow sides of the ellipse are less than the density of the bristles or tufts on the long sides of the ellipse. As an alternative non-limiting embodiment, the invention relates to a volume hair dryer brush where the narrow sides of the ellipse lack bristles or tufts whatsoever. As a further non-limiting embodiment, the invention relates to a volume hair dryer brush with an elliptical barrel where the barrel is coated in whole or in part, including but not limited to having coating in the shape of strips at any location on the barrel. The invention also includes, but is not limited to, a volume hair dryer brush having an elliptical barrel wherein the handle that attaches to the barrel is detachable.

16 Claims, 2 Drawing Sheets

Related U.S. Application Data filed on May 11, 2021, provisional application No. 63/187,306, filed on May 11, 2021.

(51) Int. Cl.
*A45D 20/48* (2006.01)
*A45D 20/50* (2006.01)

(58) Field of Classification Search
CPC ..... A45D 20/10; A45D 20/12; A45D 20/48; A45D 20/50; A45D 20/52; A45D 1/04; A45D 1/18; A46B 15/003; A46B 15/0022; A46B 15/0055; A46B 2200/104; A46B 9/023
See application file for complete search history.

(56) References Cited

U.S. PATENT DOCUMENTS

| | | | | |
|---|---|---|---|---|
| 2002/0092196 | A1 | 7/2002 | Tobin et al. | |
| 2003/0052115 | A1* | 3/2003 | Leung | A45D 20/50 132/118 |
| 2008/0223387 | A1 | 9/2008 | Julemont | |
| 2009/0229624 | A1* | 9/2009 | Purvis | A45D 20/525 186/59 |
| 2011/0220141 | A1 | 9/2011 | Chan | |
| 2015/0122286 | A1 | 5/2015 | Valle | |
| 2017/0112271 | A1* | 4/2017 | Gulamani | A46B 15/003 |
| 2017/0273430 | A1* | 9/2017 | Heffer | A46B 11/00 |
| 2021/0007457 | A1* | 1/2021 | Tam | A45D 20/50 |
| 2021/0007472 | A1* | 1/2021 | Chu | A45D 20/52 |
| 2022/0167733 | A1* | 6/2022 | Kaizuka | A46B 15/0051 |
| 2022/0287448 | A1* | 9/2022 | Durham | A46B 15/0051 |
| 2022/0354231 | A1* | 11/2022 | Pulfrey | A46B 15/0051 |

* cited by examiner

VOLUME HAIR DRYER BRUSH

CROSS-REFERENCE TO RELATED APPLICATIONS

The present invention is a non-provisional application claiming benefit from a U.S. Provisional Application No. 63/187,331, filed May 11, 2021, as well as U.S. Provisional Application No. 63/187,306 and Provisional Application No. 63/187,305, also filed on May 11, 2021. The contents of the three provisional applications are herein incorporated by reference.

FIELD OF TECHNOLOGY

The present invention relates to a volume hair dryer brush. As one non-limiting example, the invention relates to a volume hair dryer brush with an roughly elliptical barrel. As another non-limiting embodiment, the invention relates to a volume hair dryer brush with a roughly elliptical barrel where the density of the bristles and tufts on the narrow sides of the ellipse are less than the density of the bristles or tufts on the long sides of the ellipse. As an alternative non-limiting embodiment, the invention relates to a volume hair dryer brush where the narrow sides of the ellipse lack bristles or tufts whatsoever. As a further non-limiting embodiment, the invention relates to a volume hair dryer brush with an elliptical barrel where the barrel is coated in whole or in part, including but not limited to having coating in the shape of strips at any location on the barrel. The invention also includes, but is not limited to, a volume hair dryer brush having an elliptical barrel wherein a handle that attaches to the barrel is detachable.

BACKGROUND

The cross-section of the barrel of prior art volume hair dryer brushes tends to be of two shapes: (1) either the barrel is completely round or (2) the barrel has two wider side surfaces that are relatively flat with minimal curvature.

There are disadvantages to both shapes of prior art volume hair dryer brushes. For example, in the round barrel volume hair dryer brushes, the bristles or tufts tend to be the same length, material, and shape regardless of the placement on the barrel. Additionally, round volume hair dryer brushes easily tangle, which affects the smoothing properties of the brush and decreases the likelihood of use.

Prior art volume hair dryer brushes that have a barrel having a cross section with relatively flat surfaces are known to create dents, particularly with less skilled users. Additionally, the flat profile volume hair dryer brush also can be more difficult to get close to the hair root and provide lift for volume.

There is a need for a volume hair dryer brush where it is easier to work the dryer brush through the hair. There is also a need for a volume hair dryer brush that improves and increases the heat and air contact with the hair, and allows for better root coverage than prior art volume hair dryer brushes. Additionally, there is a need for a volume hair dryer brush that shows improvement in lift and volume as well as smoothing, without causing dents to occur during use.

SUMMARY OF THE INVENTION

The present invention encompasses embodiments of a volume hair dryer brush where the cross-section of the barrel is roughly elliptical in shape.

In the volume hair dryer brush of the present invention, the barrel, when viewed in cross section, is in the shape of an ellipse. There are two sides that are longer along the ellipse, the "long sides", and two sides that are narrower along the curve of the ellipse, the "narrow sides". In one non-limiting embodiment, both the long sides and the narrow sides have a curved surface. In one non-limiting embodiment, there is a grip portion that is attached to the top of the barrel. The grip portion may be of any shape or material that can assist the user in using the tool. In one non-limiting embodiment, the grip portion is designed to remain cooler to the touch than the heated surfaces of the barrel.

In one non-limiting embodiment, the volume hair dryer brush may have an elliptical barrel that is attached to a handle. In some non-limiting embodiments, the handle of such a brush may be detachable.

In some non-limiting embodiments, the volume hair dryer brush is powered by an electrical source and may be corded or cordless. In other non-limiting embodiments, the volume hair dryer brush may be powered by any source of energy, including but not limited to by battery or by solar energy.

In some non-limiting embodiments of the volume hair dryer brush, the barrel will avoid having curves that approximate a round shape, i.e., the length of the narrow sides will be less than the length of the long sides. In other non-limiting embodiments, the narrow sides of the roughly elliptical barrel of the volume hair dryer brush will be shorter in the length than the long sides, but the length of the narrow sides should be sufficiently large so as to not create dents upon use.

Another way to describe the roughly elliptical shape of the barrel of the volume hair dryer brush is to refer to the two axis components of an ellipse, i.e., the major axis of the ellipse which is longest diameter of the ellipse ($E_l$) and the minor axis of the ellipse which is the shorter diameter of the ellipse ($E_s$). In preferred embodiments, $E_s$ will be less than $E_l$. In some preferred embodiments, the length of the minor axis of the ellipse will be about 10%-85% the length of the major axis of the ellipse, about 25%-75% the length of major axis of the ellipse, about 25%-67% the length of the major axis of the ellipse, about 25%-50% the length of the major axis of the ellipse, about 50%-67% of the length of the major axis of the ellipse, or about 50%-75% of the length of the major axis of the ellipse. In one preferred embodiment, the length of the minor axis of the ellipse will be about 50% the length of the major axis of the ellipse. In an alternative preferred embodiment, the length of the minor axis of the ellipse will be about 60%-67% the length of the major axis of the ellipse.

The elliptical shape of the barrel of the volume hair dryer brush of embodiments of the present invention may also be described in terms of the curvatures associated with the narrow sides and the curvature associated with the long sides. In one non-limiting embodiment, the curvature associated with the narrow sides may be equal to or greater than the curvature associated with the long sides of the barrel, i.e., the narrow sides will have the same curve or a tighter curve than the long sides.

In some non-limiting embodiments, the barrel of the volume hair dryer brush has bristles or tufts that can be of any type, size, or shape and placed in any pattern or at random on the barrel. In some non-limiting embodiments, the bristles or tufts (1) could be flexible, semi-flexible, firm, rigid, or any combination thereof; (2) could vary in height or be uniform in height; (3) could have a variety of diameters or cross-sections, be fin-shaped, taper, be uniform in diameter, or any combination thereof; or (4) could be set in waves and/or have a ball ends. Multiple types of bristles or tufts may be combined on the same volume hair dryer brush. The bristles or tufts may be made of any natural, synthetic, or a combination of natural and synthetic material that will withstand the heat generated by the volume hair dryer brush, including but not limited to silicone bristles or tufts, silicone-coated bristles or tufts, nylon bristles or tufts, plastic bristles or tufts, metal bristles or tufts, or coated metal bristles or tufts.

In some non-limiting embodiments of the volume hair dryer brush, the bristles or tufts may be placed on the long sides of the roughly elliptical barrel as well as on the narrow sides of the barrel so long as the density of the bristles or tufts on the narrow sides is less dense than the density of the bristles or tufts that are placed on the long sides. In an alternative non-limiting embodiment, the narrow sides of the barrel may not have any bristles or tufts and thus the narrow sides of the barrel are fully exposed, providing a significant amount of surface area to contact the hair with airflow and heat. In another alternative non-limiting embodiment, one of the narrow sides of the barrel does not have bristles or tufts while the other narrow side has bristles or tufts that are less dense than the bristles or tufts on the long sides of the barrel.

In embodiments having a lack of bristles or tufts on one or both of the narrow sides of the barrel, or alternatively having a decrease in density of the bristles or tufts one or both of the narrow sides, the volume hair dryer brush is easier to use, creates less friction, allows for better heat permeation including but not limited to at the roots, smooths hair, greatly increases lift and volume, and/or can decrease the amount of time that the hair is exposed to heat resulting in less damage to the hair.

In some non-limiting embodiments, the bristles or tufts on the long sides and, when present, the narrow sides may be permanently set in place in rows or in a pattern or set randomly. In other preferred embodiments, the arrangement of bristles and tufts may, but is not required to, vary between the long sides and narrow sides or vary between each of the four sides of the barrel.

In non-limiting embodiments of the present invention, any bristle or tuft in any configuration may be used so long as there are no bristles or tufts on either or both of the narrow sides of the barrel or, alternatively, the density of the bristles or tufts on either or both of narrow sides of the barrel is less than the density of the bristles or tufts on the long sides of the barrel.

As non-limiting examples, less density can be obtained by having fewer bristles or tufts on the narrow sides than on the long sides of the barrel; by having finer bristles or tufts on the narrow sides than on the long sides; and/or by having bristles or tufts of a different shape, thickness, height, or kind on the narrow sides versus the long sides. In another non-limiting example, the bristles or tufts on one or more of the narrow sides create less friction per inch against hair than the bristles or tufts on the long sides. In one non-limiting embodiment, one or both of the narrow sides of the volume hair dryer brush may have a single row of bristles or tufts.

In some non-limiting embodiments of the volume hair dryer brush, the barrel may have vents through which air may be forced so as to blow dry the hair. The volume hair dryer brush may have vents that are of any shape, including but not limited to oval-shaped, circular, curved, or slotted. Further, the vents may be of the same size or of varying sizes. Additionally, the vents may be placed in any pattern or at random on the barrel. In some embodiments, the vents may have differing sizes, shapes, and/or be in different patterns on the same barrel. In one non-limiting embodiment, the vents may be placed in a curving repeating pattern. In another non-limiting embodiment, the vents may be placed in a series of straight lines. In one non-limiting embodiment, the pattern of the vents on the long sides of the barrel may differ from the pattern of the vents on the narrow sides of the barrel.

Non-limiting embodiments of the volume hair dryer brush of the present invention also may include brushes where the barrel may have texture and/or a coating. As a non-limiting example, any side of the barrel may have texture and/or a coating located on all or substantially all of at least one side of the barrel. In another non-limiting embodiment, the volume hair dryer brush may have all or substantially all of sides of the barrel coated. In further non-limiting embodiments, the areas of texture and/or coating may be in the shape of strips, dots, channels or other shapes or patterns or at random on any location of the barrel.

In some non-limiting embodiments, one or both of the narrow sides of the barrel can be fully or partially covered with texture and/or coating. In other non-limiting embodiments, the narrow sides of the barrel may have texture and/or coatings in the shape of strips. In other non-limiting embodiments, one or both of the narrow sides of the barrel may not be coated, may not be textured, or may not be coated or textured.

In other non-limiting embodiments, the coating material may protect the hair from heat and/or promote shine. Such coatings, when present, can include, but are not limited to coatings made of silicone. Other non-limiting examples of coatings may include, but are not limited to silicone strips and/or silicone strips with silicone bristles. In certain non-limiting embodiments, volume hair dryer brushes where one or both of the narrow sides do not have any bristles or tufts may have coating in any pattern or placement. In other non-limiting embodiments, volume hair dryer brushes where one or both of the narrow sides are less dense than the bristles or tufts on the long sides of the barrel may have a coating in any pattern or placement.

BRIEF DESCRIPTION OF THE DRAWINGS

The features, nature, and advantages of the present disclosure will become more apparent from the detailed description set forth below when taken in conjunction with the drawings which correspond to the same.

DETAILED DESCRIPTION OF EMBODIMENTS

Figure 1A:
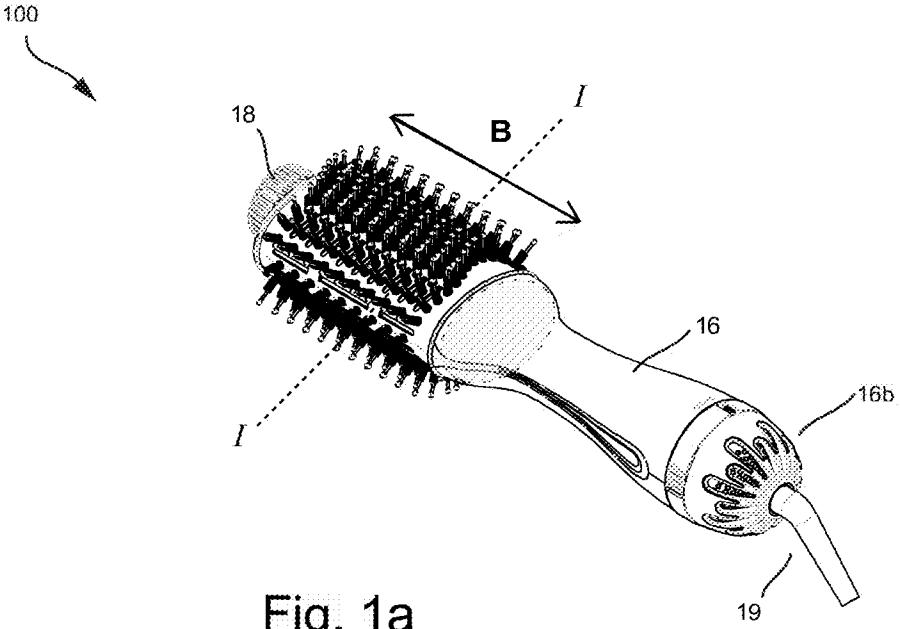
FIG. 1*a* illustrates an example of the volume hair dryer brush from the perspective view of the brush. A cross-sectional view of the barrel is indicated in shading.

Reference will now be made in detail to the embodiments of the present disclosure, examples of which are illustrated in the accompanying drawings. The reference numerals used in the detailed description of the embodiment below correspond to the reference numerals used in the accompanying drawings.

The present invention encompasses embodiments of a volume hair dryer brush having a roughly elliptical barrel. FIGS. 1*a*, 2, 3*a*, and 3*b* depict an exemplary, non-limiting embodiment of the invention set forth herein. FIGS. 1*b* and 1*c* depict ellipses, with FIG. 1*b* identifying the long and narrow sides of an ellipse, and FIG. 1*c* identifying the major and minor axis of an ellipse.

Figure 1B:
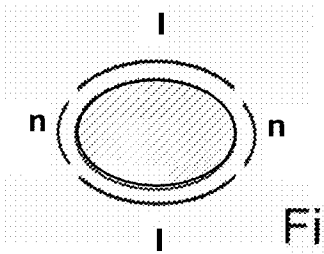
FIG. 1B is a model of an elliptical barrel of a volume hair dryer brush generally identifying the long and short sides of the barrel.
Figure 1C:
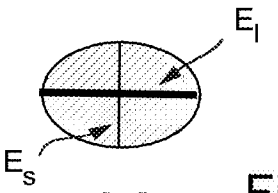
FIG. 1*c* is a model of an elliptical barrel of a volume hair dryer brush indicating the major and minor axis of the elliptical barrel.

FIG. 1*a* depicts an example of a volume hair dryer brush 100 from a perspective view of the brush, where the barrel B is roughly elliptical. The cross section of barrel B, in shading, consists of two sides that are longer along the ellipse, the "long sides" denoted 1 in FIG. 1*b*, and two sides that are narrower along the ellipse, the "narrow sides" denoted n in FIG. 1*c*. In preferred embodiment, both the long sides l and the narrow sides n have a curved surface.

In FIG. 1*a*, the volume hair dryer brush 100 has a grip portion 18 that is attached to the top of the barrel B, and a handle 16 is attached to the bottom of the barrel B having a handle end 16*b*. The grip portion 18 is optional and may be of any shape or material that can assist the user in using the tool. In one preferred embodiment, the grip portion 18 is designed to remain cooler to the touch than the heated surfaces of the barrel.

In one preferred embodiment, the volume hair dryer brush may have an elliptical barrel that is attached to a handle. The handle may be decorative in some preferred embodiments, such as shown in FIGS. 1*a*, 2, 3*a*, and 3*b*. In other preferred examples, the handle may be plain. In still further preferred embodiments, the handle of such a brush may be detachable.

While FIG. 1 depicts a volume hair dryer brush 100 that is powered by an electrical source, indicated by the cord 19 attached to the handle end 16*b*, other preferred embodiments of the volume hair dryer brush 100 may be cordless. The volume hair dryer brush 100 may be powered by any source of energy, including but not limited to by battery or by solar energy.

Figure 2:
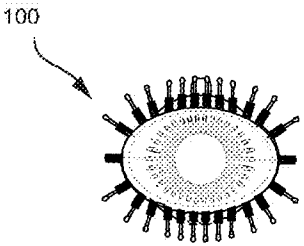
FIG. 2 illustrates an example of the volume hair dryer brush from the top view of the brush.

FIG. 2 depicts an example of a volume hair dryer brush 100 from a top view of the brush. As indicated in FIG. 1*a*, in preferred embodiments, the barrel B of the volume hair dryer brush 100 will avoid having curves that approximate a round shape, i.e., the length of the narrow sides n will be less than the length of the long sides l. In other preferred embodiments, the narrow sides n of the roughly elliptical barrel B of the volume hair dryer brush 100 will be shorter in the length than the long sides l, but the length of the narrow sides n should be sufficiently large so as to not create dents upon use.

Another way to describe the rough shape of the cross-section of the barrel B of the volume hair dryer brush 100 is to refer to the two axis components of an ellipse. In FIG. 1*c*, the major axis of the ellipse which has the longest diameter of the ellipse is identified as $E_l$, and the minor axis of the ellipse that has the shortest diameter of the ellipse is labeled $E_s$. In preferred embodiments, $E_s$ will be less than Et. In some preferred embodiments, the length of the major axis of the ellipse will be about 10%-85% the length of the minor axis of the ellipse, about 25%-75% the length of major axis of the ellipse, about 25%-67% the length of the minor axis of the ellipse, about 25%-50% the major length of the axis of the ellipse, about 50%-67% of the length of the major axis of the ellipse, or between about 50%-75% of the length of the major axis of the ellipse. In one preferred embodiment, the length of the minor axis of the ellipse may be about 50% the length of the major axis of the ellipse. In an alternative preferred embodiment, the length of the minor axis of the ellipse will be about 60%-67% the length of the major axis of the ellipse.

The elliptical cross-section of the barrel B of the volume hair dryer brush 100 may also be described in terms of the curvatures associated with the narrow sides n and the curvature associated with the long sides l, as indicated in FIG. 1*b*. In one preferred embodiment, the curvature associated with the narrow sides n may be equal to or greater than the curvature associated with the long sides l of the barrel B, i.e., the narrow sides n will have the same curve or a tighter curve than the long sides l.

Figure 3A:
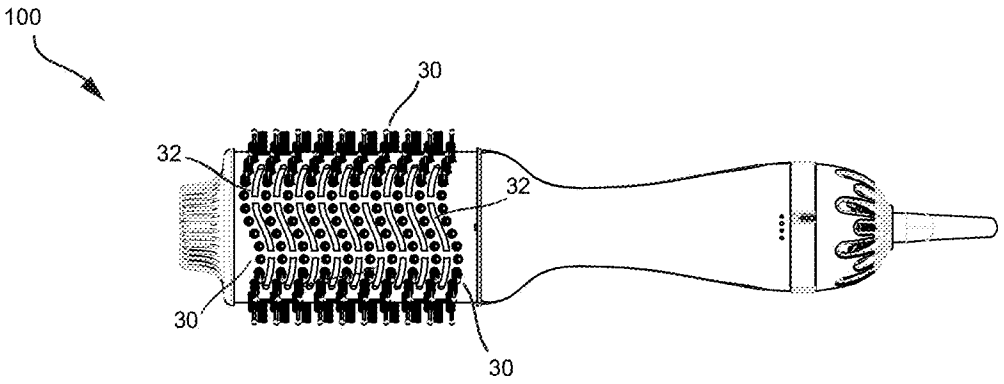
FIG. 3*a* illustrates an example of the volume hair dryer brush from the front view of the brush.
Figure 3B:
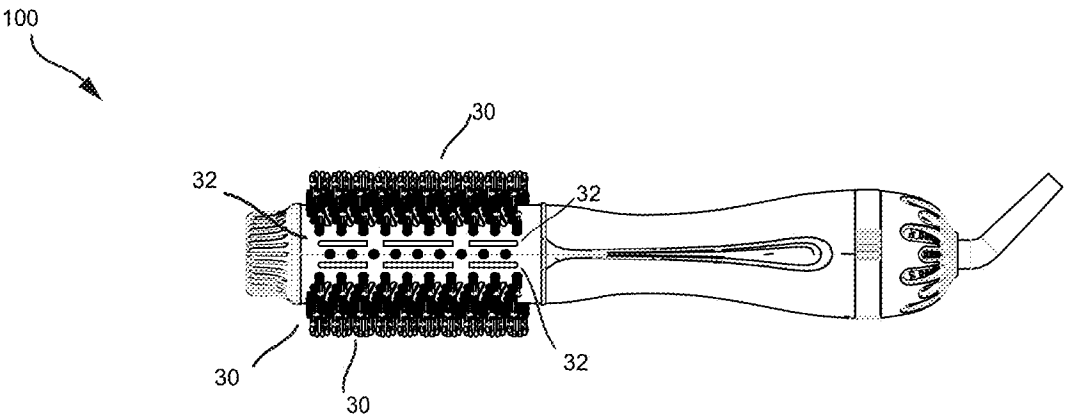
FIG. 3*b* illustrates an example of the volume hair dryer brush from the side view of the brush.

A view of the front of the volume hair dryer brush 100 is shown in FIG. 3*a* and a view of the side of the volume hair dryer brush 100 is shown in FIG. 3*b*. As indicated in FIG. 3*a* and FIG. 3*b*, in preferred embodiments the barrel B of the volume hair dryer brush 100 has bristles or tufts 30 that can be of any type, size, or shape and placed in any pattern or at random on the barrel B.

In some preferred embodiments, the bristles or tufts (1) could be flexible, semi-flexible, firm, rigid, or any combination thereof; (2) could vary in height or be uniform in height; (3) could have a variety of diameters or cross-sections, be fin-shaped, taper, be uniform in diameter, or any combination thereof; or (4) could be set in waves and/or have a ball ends. Multiple types of bristles or tufts may be combined on the same volume hair dryer brush. The bristles or tufts may be made of any natural, synthetic, or a combination of natural and synthetic material that will withstand the heat generated by the volume hair dryer brush, including but not limited to silicone bristles or tufts, silicone-coated bristles or tufts, nylon bristles or tufts, plastic bristles or tufts, metal bristles or tufts, or coated metal bristles or tufts.

In preferred embodiments of the volume hair dryer brush 100, as shown in FIG. 3*a* and FIG. 3*b*, the bristles or tufts 30 may be placed on the long sides l of the roughly elliptical barrel B as well as on the narrow sides n of the barrel B so long as the density of the bristles or tufts 30 on the narrow sides n is less dense than the density of the bristles or tufts 30 that are placed on the long sides l. In an alternative preferred embodiment (not shown), the narrow sides n of the barrel B do not have any bristles or tufts 30. In this alternative preferred embodiment, the narrow sides n of the barrel B are fully exposed, providing a significant amount of surface area to contact the hair with airflow and heat. In another alternative preferred embodiment (not shown), one of the narrow sides n of the barrel B does not have bristles or tufts 30 while the other narrow side n has bristles or tufts 30 that are less dense than the bristles or tufts on the long sides l of the barrel B.

In preferred embodiments, the lack of bristles or tufts 30 on one or both of the narrow sides n of the barrel B, or alternatively the decrease in density of the bristles or tufts 30 on one or both of the narrow sides n, makes the dryer brush easier to use, creates less friction, allows for better heat permeation including but not limited to at the roots, smooths hair, greatly increases lift and volume, and/or can decrease the amount of time that the hair is exposed to heat resulting in less damage to the hair.

In some preferred embodiments, the bristles or tufts 30 on the long sides l and, when present, the narrow sides n may be permanently set in place in rows or in a pattern or set randomly. In other preferred embodiments, the arrangement of bristles and tufts 30 may, but is not required to, vary between the long sides land narrow sides n or vary between each of the four sides of the barrel B.

In preferred embodiments, any bristle or tuft 30 in any configuration may be used so long as there are no bristles or tufts 30 on either or both of the narrow side n of the barrel B or, alternatively, the density of the bristles or tufts on either or both of narrow side n of the barrel B is less than the density of the bristles or tufts 30 on the long sides l of the barrel B.

As non-limiting preferred examples, less density can be obtained by having fewer bristles or tufts on the narrow sides than on the long sides of the barrel; by having finer bristles or tufts on the narrow sides than on the long sides; or by having bristles or tufts of a different shape, thickness, height, or kind on the narrow sides versus the long sides. In another preferred example, the bristles or tufts on one or more of the narrow sides create less friction per inch against hair than the bristles or tufts on the long sides. As one non-limiting preferred example, one or both of the narrow sides of the dryer brush may have a single row of bristles or tufts.

FIG. 3*a* and FIG. 3*b* also include a preferred embodiment where the barrel B also has vents 32 through which air may be forced so as to blow dry the hair. While FIG. 3*b* depict vents 32 that are slotted and FIG. 3*a* depicts vents 32 that are curved, other preferred embodiments may have vents that are of any shape, including but not limited to slotted or circular shapes, and/or vents that are of the same or varying sizes. FIG. 3*a* depicts a preferred embodiment where the vents 32 are curved and placed in a curving repeating pattern. FIG. 3*b* depicts a preferred embodiment where the vents 32 are slotted and placed in a series of straight lines. In other preferred embodiments, the vents may be placed in any pattern or at random on the barrel B. As shown in FIG. 3*a* and FIG. 3*b*, in one preferred embodiment, the pattern of the vents 32 on the long sides l of the barrel B may differ from the pattern of the vents 32 on the narrow sides n of the barrel B. In other preferred embodiments, the location of the vents 32 on each of the four sides (the two long sides l and the two narrow sides n) of the barrel B may be independent of one other side, two other sides, or the three other sides of the barrel B.

In another preferred embodiment (not shown), the barrel of the volume hair dryer brush may have texture and/or a coating. As one preferred example, any side of the barrel may have texture and/or a coating located on all or substantially all of at least one side of the barrel. In another preferred embodiment, the volume hair dryer brush may have all or substantially all of sides of the barrel coated. In further preferred embodiments, the areas of texture and/or coating may be in the shape of strips, dots, or other shapes, or at random, on any location of the barrel.

Preferred embodiments also may include volume hair dryer brushes where one or both of the narrow sides of the barrel are fully or partially covered with texture and/or coating. In other preferred embodiments, both of the narrow sides of the barrel may have texture and/or coatings in the shape of strips of any length or width. In some preferred embodiments, one or both of the narrow sides of the barrel may not be coated, may not be textured, or may not be coated or textured.

In other preferred embodiments, the barrel of the volume hair dryer brush may have a coating that may protect the hair from heat and/or promote shine. Such coatings, when present, can include, but are not limited to coatings made of silicone. In one preferred embodiment, the coating comprises one or more silicone strips, silicone strips with silicone bristles, silicone strips with silicone knobs or bumps, and/or silicone channels.

In certain preferred embodiments, a coating may be used in any pattern or placement on a volume hair dryer brushes having a roughly elliptical barrel where one or both of the narrow sides of the barrel do not have any bristles or tufts. In other preferred embodiments, a coating may be used in any pattern or placement on a volume hair dryer brushes having a roughly elliptical barrel where one or both of the narrow sides of the barrel have bristles or tufts that are less dense than the bristles or tufts on the long sides of the barrel.

In one preferred embodiment, the volume hair dryer brush may be, but is not required to be, coated with any heat conductive material, including but not limited to ceramic or ceramic or silicone or titanium, tourmaline, copper, or other metals, to reflect heat from the hot air of the dryer. In some preferred embodiments, all surfaces of the barrel of the heated straightening dryer brush may be heated, directly or indirectly, from any known heating mechanism other than exposure to the hot air of the dryer. In other preferred embodiments, any of the surfaces of the heated straightening dryer brush, including but not limited to the exposed curved side surfaces, also could be separately heated, directly or indirectly, from any known heating mechanism other than exposure to the hot air of the dryer.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular configurations of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

What is claimed is:

1. A volume hair dryer brush comprising: a barrel having an elliptical cross section, wherein the brush emits hot air, wherein, when viewed from top of the brush, the barrel has two long sides each having a fixed length I and two narrow sides each having a fixed length n, wherein all sides of the barrel have a curved surface, wherein the fixed length n of the narrow sides of the barrel is less than the fixed length I of the long sides of the barrel, wherein both of the long sides of the barrel have fixed bristles and/or tufts, wherein both of the narrow sides of the barrel do not have any bristles and/or tufts, wherein at least one of the sides of the barrel is heated solely by the hot air of the brush, wherein at least a portion of the barrel has texture and/or a coating, and wherein the texture and/or coating is located only on the narrow sides of the barrel.

2. The volume hair dryer brush of claim 1, wherein the elliptical barrel has a major axis having a length $E_l$ which is a longest diameter of the ellipse, wherein the ellipse has a minor axis length $E_s$, which is a shortest diameter of the ellipse, and wherein the length $E_s$ is less than the length $E_l$.

3. The volume hair dryer brush of claim 1, wherein the texture and/or coating is comprised of silicone.

4. The volume hair dryer brush of claim 1, wherein at least one side of the barrel is partially or fully coated with a heat conductive material to reflect heat from the volume hair dryer brush.

5. The volume hair dryer brush of claim 4, wherein the heat conductive material includes at least one of materials selected from group consisting of ceramic, silicone, titanium, tourmaline, copper, and other metals.

6. The volume hair dryer brush of claim 1, wherein the texture and/or coating is located only on the long sides of the barrel.

7. The volume hair dryer brush of claim 1, wherein the barrel has one or more vents.

8. The volume hair dryer brush of claim 1, wherein a curvature of the narrow sides of the barrel is greater than a curvature of the long sides of the barrel.

9. A volume hair dryer brush comprising: a barrel having an elliptical cross section, wherein the brush emits hot air, wherein, when viewed from top of the brush, the barrel has two long sides each having a fixed length I and two narrow sides each having a fixed length n, wherein all sides of the barrel have a curved surface, wherein the fixed length n of the narrow sides of the barrel is less than the fixed length I of the long sides of the barrel, wherein both of the long sides of the barrel have fixed bristles and/or tufts, with one long side of the barrel having bristles and/or tufts having a density $d_1$ and the other long side of the barrel having bristles and/or tufts having a density $d_2$, wherein both of the narrow sides of the barrel have fixed bristles and/or tufts, with one narrow side of the barrel having bristles and/or tufts having a density $d_3$ and the other narrow side of the barrel having bristles and/or tufts having a density $d_4$, wherein the density $d_3$ is (i) less than the density $d_1$ and (ii) less than the density $d_2$, wherein the density $d_4$ is (iii) less than the density $d_1$ and (iv) less than the density $d_2$, wherein both of the narrow sides of the barrel are configured to increase heat permeation relative to either of the long sides of the barrel, wherein at least a portion of the barrel has texture and/or a coating, and wherein the texture and/or coating is located only on the long sides of the barrel.

10. The volume hair dryer brush of claim 9, wherein the elliptical barrel has a major axis having a length $E_l$ which is a longest diameter of the ellipse, wherein the ellipse has a minor axis length $E_s$, which is a shortest diameter of the ellipse, and wherein the length $E_s$ is less than the length $E_l$.

11. The volume hair dryer brush of claim 9, wherein the texture and/or coating is comprised of silicone.

12. The volume hair dryer brush of claim 9, wherein at least one side of the barrel is partially or fully coated with a heat conductive material to reflect heat from the volume hair dryer brush.

13. The volume hair dryer brush of claim 12, wherein the heat conductive material includes at least one of materials selected from group consisting of ceramic, silicone, titanium, tourmaline, copper, and other metals.

14. The volume hair dryer brush of claim 9, wherein the texture and/or coating is located only on the long sides of the barrel.

15. The volume hair dryer brush of claim 9, wherein the barrel has one or more vents.

16. The volume hair dryer brush of claim 9, wherein a curvature of the narrow sides of the barrel is greater than a curvature of the long sides of the barrel.

* * * * *